United States Patent [19]

Hussar et al.

[11] 3,942,741

[45] Mar. 9, 1976

[54] REEL CONSTRUCTION

[75] Inventors: Joseph Paul Hussar, Dunstable, Mass.; Ralph Albert Jolie, Fort Wayne, Ind.

[73] Assignee: General Electric Company, New York, N.Y.

[22] Filed: Oct. 3, 1974

[21] Appl. No.: 511,660

[52] U.S. Cl. ..... 242/118.7; 40/306

[51] Int. Cl.[2] ..... B65H 75/14

[58] Field of Search..... 242/118.4, 118.41, 118.6, 242/118.7; 40/306, 307, 309; 206/509, 459, 821

[56] References Cited

UNITED STATES PATENTS

| | | | |
|---|---|---|---|
| 2,190,013 | 2/1940 | Byers | 242/118.4 |
| 3,462,097 | 8/1969 | Wilson | 242/118.4 |
| 3,606,195 | 9/1971 | Freeman, Jr. et al. | 242/118.7 |

*Primary Examiner*—Leonard D. Christian
*Attorney, Agent, or Firm*—Raymond G. Simkins; Philip L. Schlamp; Frank L. Neuhauser

[57] ABSTRACT

A reel construction which among other innovations and improvements, enables the production of reels by the formation of identical half sections thereof which can be joined one to another in pairs to provide a complete reel unit, and including means facilitate labeling and to afford stable axial end stacking of the reel product.

14 Claims, 2 Drawing Figures

REEL CONSTRUCTION

BACKGROUND OF THE INVENTION

This invention relates to reels or spools, typically comprising a shaft provided with a pair of axially spaced annular rims, for the packaging or containment, and shipping or storage of products or materials of substantial length, such as wire or cable, cordage, hose, textiles and like articles.

Plastics have become a common substitute for wood in the construction of reels in the smaller sizes and/or for lighter duty service. However, the manufacture of plastic reels by injection molding or other conventional forming techniques is complex and costly, or requires the formation of a number of separate components therefor and their complex assembly and joining of parts. Moreover, many of the currently available low-cost plastic reels are so wanting in strength and durability as to preclude their use in many common types of service such as packaging of wire or cable for shipment or for containing a feed supply of material in production operations under factory conditions. High strength plastic reels, on the other hand, frequently contain so much plastic material in their more massive structures so as to render them as expensive as the costly wooden reels.

SUMMARY OF THE INVENTION

This invention comprises a novel construction for a reel which facilitates the operations employed in its production, lowers manufacturing costs, and provides high strength and durability in relation to its mass, among other innovations and advantages. The invention includes a construction for the production of the reels in conveniently formable components or half sections of identical structure whereby any and all components for the assembly of a reel of a given size are the same and anyone section can be conveniently and easily joined with any other section to produce a complete reel product.

OBJECTS OF THE INVENTION

It is a primary object of this invention to provide an improved reel construction which is economical and practical to produce, and provides high strength and durable products having many advantageous features.

It is also an object of this invention to provide a construction for reels which is readily adaptable to the use of plastic materials and conventional low cost molding techniques and thus enables the manufacture of reels by means of simplified molding and assembling procedures.

It is a further object of this invention to provide a unique composite reel construction which enables the reel products to be formed in easily moldable sections or segments that can be all identical for the same size unit, whereby all components of the product match each other and any pair thereof can be quickly joined to fully assemble the complete reel.

It is a still further object of this invention to provide a distinctive and versatile construction for molded reels providing high strength ratios with respect to their material mass, an interlocking system which stabilizes the units when stacked one upon another, and an integral receptical for the secure retention of labels or other identifying material.

BRIEF DESCRIPTION OF THE DRAWING

FIG. I of the drawing comprises a perspective view of the reel construction of this invention with the half sections separated to illustrate the means for joining same.

FIG. II of the drawing comprises a fragmentary portion of FIG. I illustrating the construction of the rim for carrying a label.

DESCRIPTION OF A PREFERRED EMBODIMENT

Figures 1, 2:
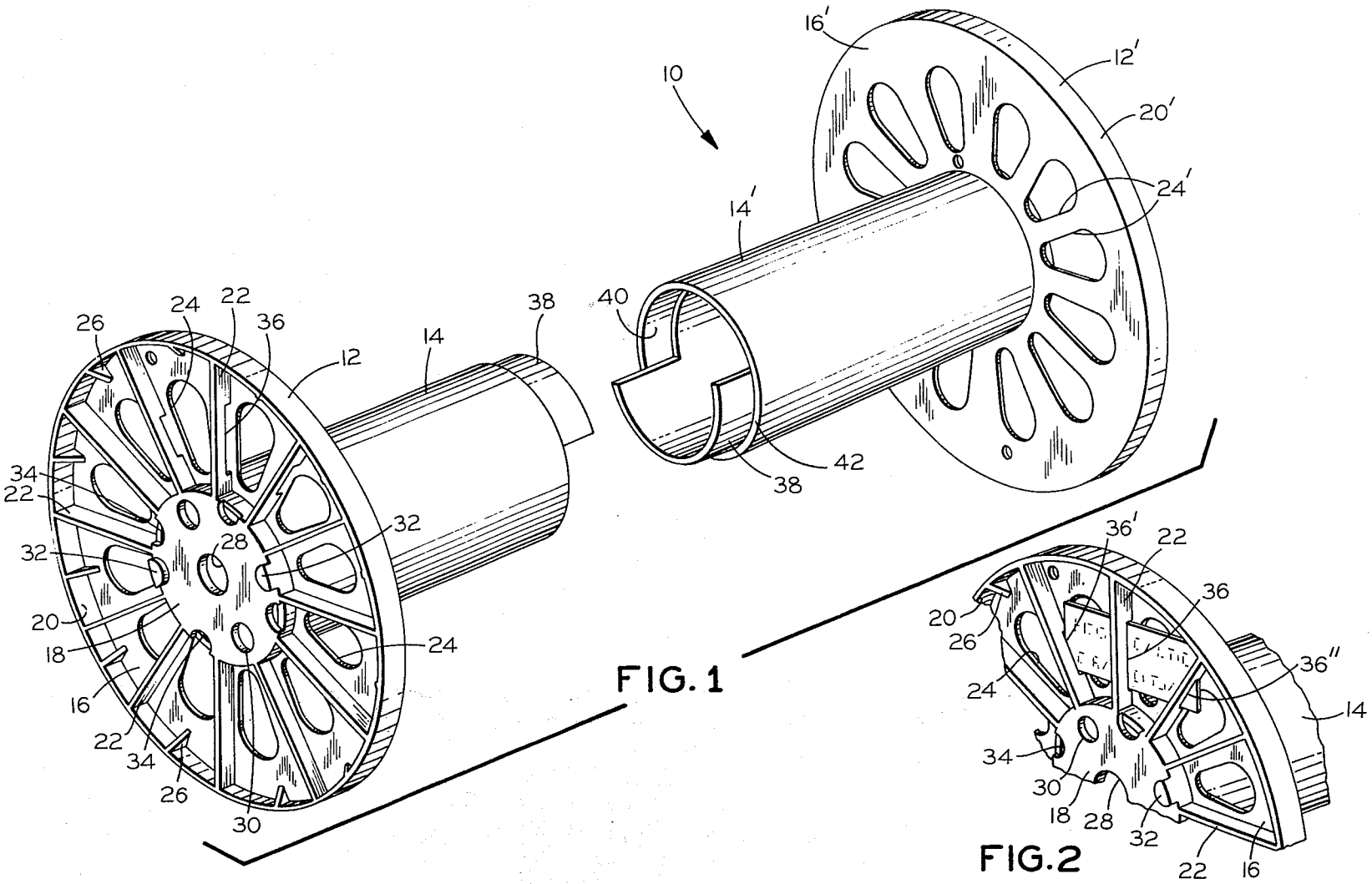

Referring to the drawing, the reel 10 of this invention is formed in two sections 12 and 12', or units, which are of matching or identical structure whereby any pair thereof can be mated and readily joined together for the assembly of the complete composite reel product 10. The configuration of the reel sections 12 and 12' of the construction of the invention, consisting of half unit segments of the overall product and comprising a portion of the shaft 14 or 14' and a rim 16 or 16', is easily formed or reproduced by molding or casting of plastics or metal with conventional techniques such as injection molding. Thus the specific distinctive construction of the invention significantly contributes to the economy of fast and effective production of all component parts of the product.

In that the reel product of the construction of this invention is composed of two half sections of identical structure and dimensions which are joined together to provide the assembled complete product, the invention is described hereinafter with respect to one of said identical half sections, unless stated otherwise.

The sections 12 of reel 10 each comprise a segment of the shaft 14 which is preferably cylindrical, but can be oval or of an angular cross-section, such as square, triangular, or other polygonal shape. Each shaft segment of the sections is provided with an annular rim 16 at one end thereof and extending radially outward from the shaft for a given distance.

A hub portion 18 at the end of the segment of the shaft 14 adjacent to the rim 16, extends axially outward a short distance from the rim 16. A cylindrical flange 20 is provided extending axially outward from the peripheral area of the rim 16, and a series of reinforcing ribs 22 extend radially from the hub portion 18 to flange 20. In a molded or cast product, the ribs 22 are preferably integrally formed with each, the rim 16, hub portion 18 and flange 20. Portions of the rim 16 intermediate the radial disposed ribs 22 may be removed or, preferably, the rim 16 is formed with voids or openings 24 intermediate the ribs 22 as means of conserving material, and also to facilitate visual determination of the reel contents.

Additionally, gusset ribs 26 are preferably provided spaced between the ribs 22 extending from the rim portion 16 to the rim flange 20 to enhance the strength and rigidity of the rims.

The hub portion 18 of the reel product 10 is provided with a center opening 28 to receive a supporting or mounting rod or lugs, and preferably with one or more off center openings 30 which are available to receive rotational drive means or simply handling devices. Further, in accordance with the improved construction of this invention, the hub portion 18 of the reel product 10 comprises a plane surface provided with one or more projections 32 extending axially outward from its surface and also with one or more depressions 34 within the surface of the hub portion. The projections 32 and depressions 34 are of corresponding configurations and alignment or pattern of distribution about the hub portion such as the circumferential uniformly arranged peripheral deployment illustrated in the drawings. Thus the projections 32 have the same radial spacing from the longitudinal axis of the shaft as the depressions 34 and thus the projections are insertable within the corresponding depressions 34 whereupon they are adapted for fitting together in a mating relationship which provides great stability when a plurality of the reels of this invention are stacked or placed one on another with one hub end adjoining another hub end. Also it is preferably that the outer edge of flange 20 be in the same plane as the face of hub portion 18 to extend the base for stacking and further increase stability. It is also preferably that there be at least two projections 32 for insertion and mating with two counterpart depressions 32 to provide for the alignment of the stacked reels and prevent lateral movement thereof.

The depressions 34 can comprise cutout portions as illustrated in the drawing, or each can comprise simply a cavity with the structure, and in either case they can be formed by machining or molding. Also the configuration of the projections 32 and corresponding depressions 34 can be semicircular as illustrated in the drawing, or of any other apt shape. Furthermore, it is essential merely that the projection on one reel and a cooperating depression of an adjacent reel be of corresponding mating relationships and be spaced radially the same distance from the longitudinal axis of the shaft to permit their mating.

Another unique feature of the construction of this invention is the provision of an integral means on the reel for receiving and securely retaining a label of other identifying or instructive material in a readily visible manner without the use or need for ancillary fastening means such as glue or staples. Specifically at least two adjacent radially extending ribs 22 are provided with cutout portions adjacent, and preferably extending down to the surface of the rim 16 which provides a series of slots 36 for the insertion of sheets of identifying or instructive material in the slots and so as to lie flat on the surface of the rim.

Preferably, the cutaway slots 36 are provided in at least three adjacent radial ribs 22, such as slots 36, 36′ and 36″. Thus, when a label of apt rectangle dimensions is inserted through the slots 36 of the radially disposed ribs 22, the slotted ribs transverse a central portion of the inserted label and also diagonally across a corner of each end of the label, thereby securely locking the label in a fully visible position without ancillary fastening means. The cutaway portion forming the slots 36, as in case of the openings 24 and depressions 34, can be formed by machining or molded into the structure.

This invention further comprises the manufacture of reels with easily molded or formed segmental components and the assembly therewith of a composite, complete reel product, utilizing only sections or components of identical or matching structures whereby any one unit can be matched and combined with any other unit to produce the completed product. A further and significant aspect of the invention is the construction of the sections or components of identical or matching structure and their distinctive system of intermating and uniting the segments of the shaft 14 to provide a strong and durable composite reel product.

Each reel section 12 or component of the product includes a segment of the shaft 14, and the end of the shaft segment opposite the rim 16 is provided with an axially projecting extension 38 and a counterposed axially directed internal recess 40 of corresponding shape and dimensions. In a preferred embodiment of this invention comprising a shaft 14 of cylindrical configuration, the extension 38 and counterposed recess 40 are each semicircular in shape and of reduced arcuate diameter with respect to the cylindrical shaft 14 whereby the sections 12 and 12′ cooperate with the intermating of the respective semicircular extension 38 and semicircular recess 40 of each section to provide a composite shaft and complete reel product 10.

As illustrated in the drawing, half circle extension 38 and half circle recess 40 compliment each other with respect to their shapes and dimensions whereby the depth and arcuate configuration of recess 40 is a counterpart of extension 38, and they receive each other in close fitting relationship to provide an effective and strong union of the shaft segments. It is also preferred that each segment of the shaft 14 be provided with a shoulder 42 encircling the extension 38 and recess 40 which are both of reduced diameter with respect to the shaft 14. Shoulder 42 provides an abutment or stop to fix the length of the shaft of the assembled reel 10.

Also, the extension 38 and recess 40 can be formed as multiple alternating units of two or more extensions in alternating series with two or more recesses on each segment of the shaft whereby the extensions and recesses of each of such segments mesh together with their counterparts of another segment to provide a secure and durable union. Extensions 38 and their counterpart recesses 40 can be of any apt configuration provided they compliment each other in location or alignment and dimensions whereby they mate in close fitting relationship.

Preferable, to insure permanence of the union of the sections 12 of the reel, an appropriate adhesive or bonding element is applied to the uniting extension and/or recess to secure the assembly.

Although the invention has been described with reference to certain specific embodiments thereof, numerous modifications are possible and it is desired to cover all modifications falling within the spirit and scope of the invention.

What I claim as new and desire to secure by letters patent of the United States is:

1. A reel having an elongated cylindrical shaft and a pair of annular rims thereabout, comprising:
   a. a shaft;
   b. an annular rim extending radially from adjacent each end of the shaft;
   c. a flange extending axially outward from adjacent the periphery of each rim;
   d. a hub at each end of the shaft extending axially outward from each rim;
   e. a plurality of ribs extending radially from the hub to the flange of each rim;
   f. said hub having at least one projection extending axially outward therefrom and at least one depression having the same radial spacing from the longitudinal axis of said shaft and the same configuration as said projection, whereby the projections and depressions of like reels are effective for fitting together in a mating relationship to enable stable hub end on hub end stacking of such reels.

2. The reel of claim 1, wherein at least two of the radial ribs are provided with elongated slots forming a holder for labels.

3. The reel of claim 1, comprising a pair of identically constructed mating sections each constituting one of said rims and half of said shaft and joined at their respective shaft ends to complete the assembly.

4. The reel of claim 1, having a cylindrical shaft and being constructed of a pair of mating sections with each comprising a segment of the cylindrical shaft and an annular rim extending from adjacent an end thereof, and wherein the end of the segment of the cylindrical shaft opposite the rim of each section is provided with an axially projecting, semicircular extension of reduced diameter and an axially directed semicircular internal recess of corresponding dimensions with said extension whereby a pair of the mating sections of the reel assemble with the intermating of the respective semicircular extension and the semicircular recess of each section to join the segments of the shaft and provide a composite shaft and complete reel.

5. The reel of claim 4, wherein each of the mating sections are of the same configuration.

6. The reel of claim 4, wherein the end of the segment of the cylindrical shaft opposite the rim of each section is provided with at least one extension and an equal number of internal recesses of corresponding arrangement and dimensions with the extensions whereby they intermeshingly mate together.

7. A reel having an elongated shaft and a pair of annular rims thereabout constructed of a matched pair of mating sections assembled together, each section of the reel comprising:

a. a segment of a shaft;
b. an annular rim extending radially from adjacent an end of the shaft segment;
c. a flange extending axially outward from adjacent the periphery of the rim;
d. a hub extending axially outward from the rim provided with at least one projection extending axially outward therefrom and at least one depression having the same radial spacing from the longitudinal axis of said shaft and the same configuration as said projections, whereby the projections and depressions of like reels are effective for fitting together in a mating relationship to enable stable hub end on end stacking of such reels; and
e. a plurality of ribs extending radially from the extended hub portion to the extended flange.

8. The reel of claim 7, wherein at least two of the radial ribs are provided with elongated slots forming a holder for labels.

9. The reel of claim 7, wherein the end of the segment of the shaft opposite the rim of each section is provided with an axially projecting extension of reduced diameter and an axially directed internal recess of corresponding dimensions with said extension whereby a pair of the mating sections of the reel assemble with the intermating of the respective extension and the recess of each section to provide a composite shaft and complete reel.

10. The reel of claim 9, wherein each of the mating sections are of the same configuration.

11. The reel of claim 9, wherein the end of the segment of the shaft opposite the rim of each section is provided with at least one extension and an equal number of internal recesses of corresponding arrangement and dimensions with the extensions whereby they intermeshingly mate together.

12. A reel having an elongated cylindrical shaft and a pair of annular rims thereabout constructed of a matched pair of mating sections assembled together, each section of the assembled reel comprising:

a. a segment of a cylindrical shaft;
b. an annular rim extending radially from adjacent an end of the shaft segment;
c. a flange extending axially outward from adjacent the periphery of the rim;
d. a hub extending axially outward from the rim;
e. a plurality of ribs extending radially from the extended hub to the extended flange; and
f. the end of each segment of the cylindrical shaft opposite the rim having an axially projecting, semicircular extension of reduced diameter and an axially directed semicircular internal recess of corresponding dimensions with said extension whereby a pair of the mating sections of the reel assemble with the intermating of the respective semicircular extension and the semicircular recess of each section to join the segments of the cylindrical shaft and provide a composite reel.

13. The reel of claim 11, wherein the hub portion is provided with at least one projection extending axially outward therefrom and at least one depression of corresponding alignment and configuration with that of the projection whereby said projection and depression fit together in a mating relationship to provide stable hub end on hub end stacking of such reels.

14. The reel of claim 11, wherein at least two of the radial ribs are provided with elongated slots forming a holder for labels.

* * * * *

UNITED STATES PATENT OFFICE

CERTIFICATE OF CORRECTION

PATENT NO. : 3,942,741

DATED : March 9, 1976

INVENTOR(S) : Joseph P. Hussar and Ralph A. Jolie

It is certified that error appears in the above-identified patent and that said Letters Patent are hereby corrected as shown below:

Column 5, line 11, after "extending" insert - radially -

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*